US005750959A

United States Patent [19]

Plumptre

[11] Patent Number: 5,750,959

[45] Date of Patent: May 12, 1998

[54] ELECTRIC HEATER

[75] Inventor: David Aubrey Plumptre, Droitwich, United Kingdom

[73] Assignee: Ceramaspeed Limited, United Kingdom

[21] Appl. No.: 646,947

[22] Filed: May 8, 1996

[30] Foreign Application Priority Data

Jun. 1, 1995 [GB] United Kingdom ..... 9511071

[51] Int. Cl.[6] ..... H05B 3/68

[52] U.S. Cl. ..... 269/465; 219/453

[58] Field of Search ..... 219/464, 465, 219/467, 468, 453, 506

[56] References Cited

U.S. PATENT DOCUMENTS

| | | | |
|---|---|---|---|
| 5,013,893 | 5/1991 | Goessler | 219/453 |
| 5,138,135 | 8/1992 | Husslien | 219/464 |
| 5,162,636 | 11/1992 | Randolph, Jr. et al. | 219/453 |
| 5,183,997 | 2/1993 | Lotz | 219/464 |
| 5,448,036 | 9/1995 | Husslein | 219/464 |
| 5,448,306 | 9/1995 | Husslein | 219/464 |

FOREIGN PATENT DOCUMENTS

| | | |
|---|---|---|
| 0359028 | 8/1989 | European Pat. Off. . |
| 0438656 | 11/1990 | European Pat. Off. . |
| 0437826 | 12/1990 | European Pat. Off. . |
| 0499972 | 2/1992 | European Pat. Off. . |
| 0540876 | 9/1992 | European Pat. Off. . |
| 0438656 | 7/1991 | Germany . |
| 4100767 | 7/1992 | Germany . |
| 2271840 | 4/1994 | United Kingdom . |

OTHER PUBLICATIONS

European Search Report—21 Oct. 1996.

*Primary Examiner*—Teresa J. Walberg
*Assistant Examiner*—Sam Paik
*Attorney, Agent, or Firm*—Ira S. Dorman

[57] ABSTRACT

An electric heater for arranging beneath a translucent cooking plate includes at least one electrical heating means, such as a ribbon, coil or filament lamp, in a housing comprising a base and a peripheral wall. Light indicator means is supported peripherally on the heater and visible, in operation, through the cooking plate. The light indicator means comprises an elongate light-emitting device at least partially surrounding the heater and arranged to emit light towards the underside of the cooking plate. Mask means is provided overlying the device and integral with the heater, the mask means being of a material substantially opaque to light from the device. The mask means has one or more apertures, different in configuration to the configuration of the device, through which one or more apertures light from the device is visible, viewed through the cooking plate.

22 Claims, 2 Drawing Sheets

ELECTRIC HEATER

This invention relates to an electric heater, such as a radiant electric heater, for arranging beneath a translucent cooking plate, such as a glass-ceramic cooking plate. More particularly, the invention relates to such a heater having at least one electrical heating means, such as a coiled wire, elongate electrically conductive ribbon, or tungsten-halogen lamp, in a housing comprising a base and a peripheral wall.

BACKGROUND TO THE INVENTION

It is known to provide light indicator means supported peripherally on a heater and visible in operation through the cooking plate, the indicator comprising an elongate light-emitting device at least partially surrounding the heater and arranged to emit light towards the underside of the cooking plate. In the case of a circular heater, the elongate light-emitting device is arranged to be correspondingly circular, or part-circular.

Such light indicator means serves particularly as a hot warning indicator for providing a visual warning when the translucent cooking plate is at a temperature at which it is unsafe to be touched.

DESCRIPTION OF PRIOR ART

Electric heaters having light indicating means of this type are described, for example, in EP-A-0 359 028, EP-A-0 438 656, and GB-A-2 271 840. The light indicating means may, for example, comprise an elongate filament lamp or an elongate gas discharge lamp, such as an elongate neon lamp. Of particular interest, however, is an indicating means comprising an elongate light guide, such as an appropriately-shaped glass rod, having a light exit region facing the underside of the cooking plate, and preferably extending substantially along the length of the light guide, and having at least one light entry region, such as one or both ends of the glass rod, arranged to receive light from a light source. The light from the source is transmitted along the light guide and the source suitably comprises a filament lamp, such as a tungsten-halogen lamp.

In operation, the light indicating means, viewed through the cooking plate, is observed as a ring of light surrounding the heater. Such a ring may be continuous or may take the form of a series of bright spots, the latter being achieved by means such as providing a series of spaced-apart notches in the surface of the light guide.

In practice, however, the observed ring of light, whether continuous or in the form of bright spots, may not be sharply defined or of uniform brightness and stray light may be visible through the cooking plate. This is aesthetically undesirable.

Furthermore, there is a requirement to be able to provide sharply-defined patterns of illumination which can readily be varied from one heater to another, if required, to meet specific visual requirements in different cooking appliances, without requiring modification to a basic elongate light-emitting device. Such specific visual requirements may also include patterns of illumination incorporating designs or logos.

OBJECT OF THE INVENTION

It is an object of the present invention to fulfill these requirements and overcome or minimise the disadvantages of the prior art.

SUMMARY OF THE INVENTION

The present invention provides an electric heater for arranging beneath a translucent cooking plate, the heater comprising: at least one electrical heating means in a housing comprising a base and a peripheral wall; light indicator means supported peripherally on the heater and visible, in operation, through the cooking plate, the light indicator means comprising an elongate light-emitting device at least partially surrounding the heater and arranged to emit light towards the underside of the cooking plate, wherein mask means is provided overlying the device and integral with the heater, the mask means being of a material substantially opaque to light from the device and having one or more apertures therein, different in configuration to the configuration of the device, through which one or more apertures light from the device is visible, viewed through the cooking plate.

The apertures are selected with regard to number, size, shape and position to provide any particular desired visual effect with good uniformity of brightness.

In a particular embodiment, a plurality of apertures are provided in the mask means, in spaced-apart relationship along the length of the light-emitting device.

The mask means is formed of a material capable of withstanding the operating temperature environment of the heater. It suitably comprises an appropriately opaque material selected from the group consisting of metals; ceramics; ceramic fibre materials; glass cloth materials.

The mask means may suitably be formed from material in sheet or strip form and may optionally be provided of substantially L-shaped cross-section whereby a downwardly-directed flange portion, preferably unapertured, provides screening of light radiating laterally from the light-emitting device and/or provides a means for securing the mask means to the heater.

The base and peripheral wall of the heater may comprise thermal and electrical insulation material suitably located in a supporting dish, such as of metal.

The light-emitting device may be located in a recess or rebate provided in the upper surface of the peripheral wall. The mask means may overlie the surface of the peripheral wall, at least in part, or may be flush with, or lower than, the surface of the peripheral wall.

Preferably the light-emitting device substantially surrounds the heater.

The mask means may serve to secure in location the light-emitting device.

The light-emitting device may be provided of various forms. It may comprise an elongate filament lamp or an elongate gas-discharge lamp such as a neon lamp. It may advantageously comprise an elongate light guide having a light exit region facing the underside of the cooking plate, and preferably extending substantially along the length of the light guide, and having at least one light entry region arranged to receive light from a light source, the light from the source being transmitted along the light guide.

The light entry region(s) may comprise one or both ends of the light guide.

The light source suitably comprises a filament lamp, such as a tungsten-halogen lamp.

The filament lamp may be located inside a housing, suitably of metal or ceramic material, which is provided with one or more apertures therein to receive the one or both ends of the light guide. The housing may have an interior surface which is light-reflective such as by provision thereon of a metallic, or other suitable, layer.

The light guide suitably comprises a glass rod which may have a substantially circular cross-section, although other cross-sections such as rectangular, oval, or triangular, could be considered.

The surface of the glass rod is adapted to allow egress of light from the light exit region facing the underside of the cooking plate. In this regard, at least an elongate surface strip of the rod constituting, and/or diametrically opposite, the light exit region may be frosted or etched or micro-roughened. Such frosted or etched or micro-roughened surface strip may be graded in degree such that the degree of frosting, etching or micro-roughening increases with increasing distance along the rod from the light entry region or regions, for example as described in GB-A-2 271 840. By this means, facility of egress of light from the light exit region increases with increasing distance along the rod from the light entry region or regions and light emitted towards the underside of the cooking plate is of substantially uniform intensity along the rod.

As an alternative to a frosted or etched or micro-roughened elongate surface strip, a corresponding elongate surface strip of the rod opposite the light exit region may be coated with a light-reflective paint, enamel or lacquer, preferably of a light colour such as white. The coated strip may be tapered in width, such that the width increases with increasing distance from the light entry region or regions, whereby substantially uniform density of emitted light along the rod is obtained.

In a particular embodiment, the electric heater is of substantially circular shape and the elongate light-emitting device is of corresponding circular, or particular, shape.

The light indicator means comprising the elongate light-emitting device is particularly suitable for use as a hot warning indicator for providing a visual warning when the translucent cooking plate, which is usually of a glass-ceramic material, is at a temperature at which it is unsafe to be touched.

The invention is now described by way of example, with reference to the accompanying drawings in which:

DESCRIPTION OF PREFERRED EMBODIMENTS

Figure 1:
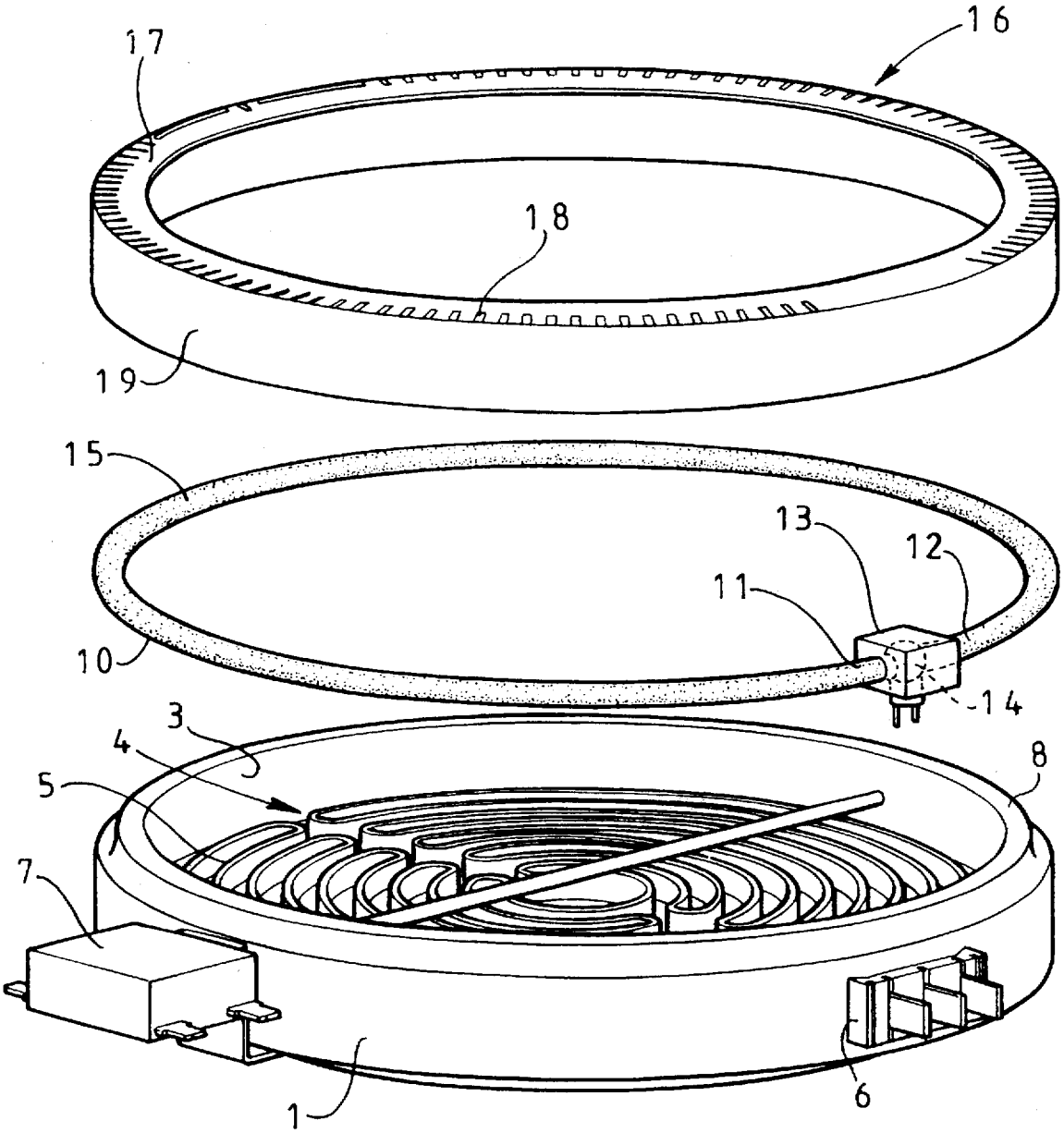
FIG. 1 is an exploded perspective view of one embodiment of an electric heater according to the invention.

A radiant electric heater, for use in a cooking appliance having a translucent glass-ceramic cook top, is constructed as follows. A circular metal dish 1 contains a base layer 2 of thermal and electrical insulation material, such as microporous thermal and electrical insulation material, which is well known to the skilled person. A heating element 4, in the form of a corrugated metal alloy strip 5, whose corrugations are not shown for simplicity, is secured to the base layer 2 by embedding therein to part of its height. If desired, the strip 5 of the element 4 may be profiled along that edge thereof which is embedded, for example by providing downwardly-extending integral spaced-apart tabs (not shown) which are embedded in the insulation material of the base layer 2.

Instead of, or additional to, the strip-form heating element 4, other well-known forms of heating element may be provided, for example a coiled wire heating element and/or a bright radiating element such as a quartz-halogen lamp or a molybdenum disilicide element.

A terminal connector 6 is provided for electrically connecting the heating element 4 to an electrical supply for operation thereof.

Against the side of the dish 1 is located a peripheral wall 3 of thermal insulation material whose top surface 8 is arranged in use to contact directly, or indirectly, the underside of a translucent glass-ceramic cooking plate 9 in a cooking appliance.

A well-known form of thermal cut-out device 7 is provided, extending over the heating element 4. The cut-out device 7 has two sets of switch contacts. One set of contacts is connected to, and arranged to switch off, the heating element 4 to prevent over-heating when the heater is installed and operating in a cooking appliance.

The other set of switch contacts in the cut-out device 7 is arranged for connection to a light indicator means, described hereinafter, which is visible in operation through the translucent glass-ceramic cooking plate 9 and serves to provide a visual warning that the surface of the cooking plate is too hot to touch and/or to provide a visual delimitation of that area of the cooking plate beneath which the heater is positioned. The light indicator means may be arranged to be illuminated, for example, when the temperature of the cooking plate reaches about 40° C.

The light indicator means comprises an elongate light guide in the form of a circular light-transmitting glass rod 10 which is located in a rebate in the peripheral wall 3 of the heater and substantially surrounds the heater. The light-transmitting rod 10 has ends 11, 12 which locate in apertures in a housing 13 which encloses a light source in the form of a halogen lamp 14. The housing 13 is suitably of ceramic or metal material and preferably has a light-reflective inner surface to enhance illumination of the ends of the light transmitting rod 10. the light-reflective inner surface may suitably comprise a metallic layer on the housing. The lamp 14 is connected to a suitable electrical supply through one of the sets of switch contacts in the cut-out device 7 and becomes illuminated when the cooking plate 9 reaches a predetermined temperature, such as 40° C.

Light from the lamp 14 is transmitted along the rod 10 and is arranged to exit radially from the rod, towards the glass-ceramic cooking plate 9. This is achieved by providing an etched, frosted or micro-roughened surface strip 15 along the length of the rod on that region of the rod either adjacent to, or diametrically opposite, the cooking plate 9, as described for example in GB-A-2 271 840. The etched, frosted or micro-roughened surface strip 15 is preferably graded such that there is an increasing degree of etching, frosting or micro-roughening with increasing distance from the ends 11, 12 of the rod where the lamp 14 is provided. By this means, substantially uniform brightness of light exiting from the rod 10 towards the cook top 9 is achieved along the length of the rod 10.

Figure 2:
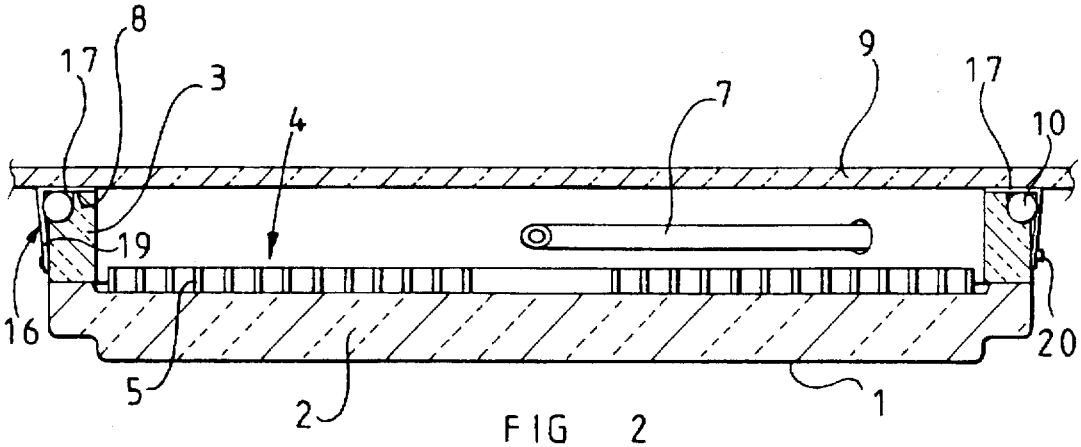
FIG. 2 is a cross-sectional view of the heater of FIG. 1 in unexploded form, located beneath a translucent cooking plate.

A mask means 16 is provided overlying the light transmitting rod 10 and integral with the heater. The mask means in its simplest form comprises a ring-shaped thin strip 17 of substantially light-opaque material provided with a pattern of apertures 18 therein different in configuration to the configuration of the light transmitting rod 10. The thin strip 17 suitably comprises a metal, although other substantially light-opaque materials such as ceramics, ceramic fibre materials or glass cloth materials could be considered. Preferably, a downwardly-directed flange portion 19 is provided on the ring-shaped strip 17 so that the resulting mask means is of substantially L-shaped cross-section. As shown in FIG. 2, the mask means locates the light transmitting rod 10 in position, the flange portion 19 being suitably secured to the metal dish 1 of the heater by forming an interference fit therewith or by means 20, such as threaded fasteners or spot welds. The upper surface of the strip 17, which is provided with the apertures 18 is arranged to be level with, or slightly below, the top surface 8 of the peripheral wall 3 of the heater, but may be arranged to overlie, at least in part, the top surface 8 of the wall.

In operation, light exiting radially from the light transmitting rod 10 passes through the apertures 18 in the mask means 16 and is visible as a sharply defined substantially uniformly bright circular pattern through the cooking plate 9. The mask means 16, particularly with its flange portion 19, prevents stray light from the rod 10 escaping in undesirable directions, particularly laterally.

It may be advantageous for the interior of the mask facing the light-transmitting rod 10 to be light-reflective, at least in part.

Any desired number, shape and pattern of apertures may be selected to provide a particular required visual effect. One or more apertures may be shaped in conformance with a logo identifying, for example, the manufacturer or supplier of the heater or cooking appliance.

By a straightforward change of apertured mask, different visual patterns may be provided from one cooking appliance to another.

Figure 3:
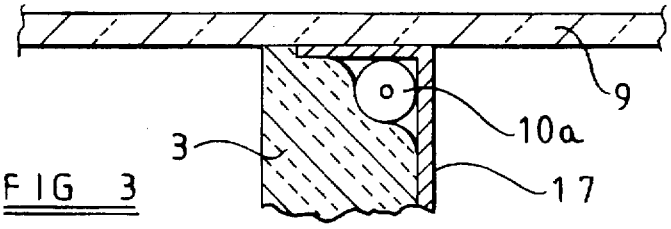
FIG. 3 is a partial cross-sectional view of a second embodiment of an electric heater according to the present invention.
Figure 4:
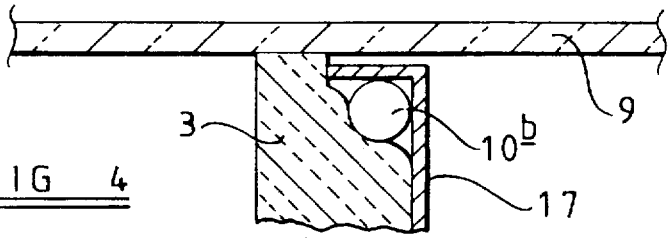
FIG. 4 is a partial cross-sectional view of a third embodiment of an electric heater according to the present invention.

Instead of the light transmitting rod 10 and lamp source 14, a ring-shaped discharge lamp, such as a neon lamp, could be used, or a ring-shaped filament lamp, the mask means 16 being equally suitable for use with these alternative arrangements. In this respect, FIG. 3 illustrates a ring-shaped filament lamp 10*a* in conjunction with a mask that is substantially flush with the upper surface of the peripheral wall 3 and FIG. 4 illustrates a ring-shaped discharge lamp 10*b* in conjunction with a mask that is at a level lower than the upper surface of the peripheral wall 3.

I claim:

1. An electric heater for arranging beneath a translucent cooking plate, the heater comprising: at least one electrical heating means in a housing comprising a base and a peripheral wall; light indicator means supported peripherally on the heater and visible, in operation, through the cooking plate, the light indicator means comprising an elongate light-emitting device at least partially surrounding the heater and arranged to emit light towards the underside of the cooking plate; and mask means overlying the device and integral with the heater, the mask means being of a material substantially opaque to light from the device and having one or more apertures therein, different in configuration to the configuration of the device, through which one or more apertures light from the device is visible, viewed through the cooking plate.

2. An electric heater according to claim 1, wherein a plurality of apertures are provided in the mask means, in spaced-apart relationship along the length of the light-emitting device.

3. An electric heater according to claim 1, wherein the mask means is formed of a material capable of withstanding the operating temperature environment of the heater.

4. An electric heater according to claim 3, wherein the mask means comprises a material selected from the group consisting of metals; ceramics; ceramic fibre materials; glass cloth materials.

5. An electric heater according to claim 1, wherein the mask means is formed from material selected from sheet form and strip form.

6. An electric heater according to claim 5, wherein the mask means is of substantially L-shaped cross-section so as to provide a downwardly-directed flange portion.

7. An electric heater according to claim 1, wherein the base and peripheral wall of the heater comprise thermal and electrical insulation material.

8. An electric heater according to claim 7, wherein the base and peripheral wall are located in a supporting dish.

9. An electric heater according to claim 1, wherein the light-emitting device is located in a recess or rebate provided in the upper surface of the peripheral wall.

10. An electric heater according to claim 9, wherein the mask means overlies the surface of the peripheral wall, at least in part.

11. An electric heater according to claim 9, wherein the mask means is flush with the surface of the peripheral wall.

12. An electric heater according to claim 9, wherein the mask means is lower than the surface of the peripheral wall.

13. An electric heater according to claim 1, wherein the mask means serves to secure in location the light-emitting device.

14. An electric heater according to claim 1, wherein the light-emitting device comprises an elongate light guide having a light exit region facing the underside of the cooking plate and having at least one light entry region arranged to receive light from a light source, the light from the source being transmitted along the light guide.

15. An electric heater according to claim 14, wherein the light exit region extends substantially along the length of the light guide.

16. An electric heater according to claim 15, wherein the light entry region is provided at one or both ends of the light guide.

17. An electric heater according to claim 16, wherein the light source is located inside a housing which is provided with one or more apertures therein to receive the one or both ends of the light guide.

18. An electric heater according to claim 17, wherein the housing has an interior surface which is light-reflective.

19. An electric heater according to claim 18, wherein the light-reflective surface comprises a metallic, or other suitable, layer.

20. An electric heater according to claim 1, wherein the light guide comprises a glass rod, the surface of which is adapted to allow egress of light from a light exit region facing the underside of the cooking plate.

21. An electric heater according to claim 1, wherein the light indicator means comprising the elongate light-emitting device serves as a hot warning indicator for providing a visual warning when the translucent cooking plate is at a temperature at which it is unsafe to be touched.

22. A cooking appliance provided with an electric heater according to claim 1.

* * * * *